US008950645B2

(12) United States Patent
Moon

(10) Patent No.: US 8,950,645 B2
(45) Date of Patent: Feb. 10, 2015

(54) TAPE HOLDER

(71) Applicant: Yoon-ho Moon, Seoul (KR)

(72) Inventor: Yoon-ho Moon, Seoul (KR)

( * ) Notice: Subject to any disclaimer, the term of this patent is extended or adjusted under 35 U.S.C. 154(b) by 193 days.

(21) Appl. No.: 13/692,816

(22) Filed: Dec. 3, 2012

(65) Prior Publication Data

US 2013/0140339 A1 Jun. 6, 2013

(30) Foreign Application Priority Data

Dec. 1, 2011 (KR) ..... 10-2011-0127704

(51) Int. Cl.
*B26F 3/02* (2006.01)
*B65H 35/06* (2006.01)
*B65H 35/00* (2006.01)

(52) U.S. Cl.
CPC ..... *B65H 35/06* (2013.01); *B65H 35/0026* (2013.01)
USPC ..... 225/77

(58) Field of Classification Search
CPC ..... B26F 3/02
USPC ..... 225/25–40, 46–48, 65–66, 77
See application file for complete search history.

(56) References Cited

U.S. PATENT DOCUMENTS 5,494,204 A * 2/1996 Wang ..... 225/25

OTHER PUBLICATIONS

Joseph Rueter, Sticky Tape Dispenser, Jan. 10, 2012.*

* cited by examiner

*Primary Examiner* — Kenneth E. Peterson
*Assistant Examiner* — Nhat Chieu Do
(74) *Attorney, Agent, or Firm* — Intellectual Property Law Group LLP

(57) ABSTRACT

Disclosed herein is a tape holder for supporting a tape roll and cutting tape from the tape roll. The tape holder includes a first holder body and a second holder body. The first holder body has an overall 'E' shape and includes a cutting part which is provided on a first end of the first holder body and on which a cutter is formed to cut the tape; a support part which is provided on a second end of the first holder body to support the tape holder on a support surface; and a coupling part provided on a medial portion of the first holder body to support the tape roll. The second holder body has the same shape as that of the first holder body. The coupling parts of the first and second holder bodies are coupled to each other in a center hole of the tape roll.

5 Claims, 5 Drawing Sheets

TAPE HOLDER

BACKGROUND OF THE INVENTION

1. Field of the Invention

The present invention relates generally to a tape holder and, more particularly, to a tape holder which is configured such that a pair of holder bodies which are manufactured to have the same shape are coupled to each other to support a tape roll and enable a user to easily cut tape from the tape roll.

2. Description of the Related Art Generally, adhesive tape is widely used to pack a substance or bond substances to each other. Adhesive tape typically has adhesive on one side thereof and is provided in a roll shape so that a user can cut off a desired length of tape from the tape roll.

In the case of the tape roll, a separate cutting tool (for example, a desk dispenser, a cutter, etc.) is required to cut off a desired length of tape from the tape roll. Further, even though a separate cutting tool is used, it is not easy to precisely cut off a required length of tape from the tape roll.

In an effort to overcome the above problems, a tape holder in which a cutter is provided on a holder that supports a tape roll so as to make it possible to cut off tape from the tape roll without using a separate cutting tool was proposed.

However, the conventional tape holder is problematic in that when it is desired to replace a tape roll with another, coupling parts which support the tape roll and are coupled to each other may be easily separated from each other whereby the user may injure his/her hand or a part of the tape holder may be damaged.

Meanwhile, a tape holder having a stand shape is comparatively large and heavy, making transport and storage difficult.

SUMMARY OF THE INVENTION

Accordingly, the present invention has been made keeping in mind the above problems occurring in the prior art, and an object of the present invention is to provide a tape holder which is configured such that separation and coupling of coupling parts can be facilitated when a tape roll is replaced with another.

Another object of the present invention is to provide a tape holder which has a light structure and a stand shape.

In order to accomplish the above object, the present invention provides a tape holder for supporting a tape roll and cutting tape from the tape roll, including: a first holder body having an overall 'E' shape and having a cutting part provided on a first end of the first holder body, with a cutter formed in the cutting part to cut the tape, a support part provided on a second end of the first holder body to support the tape holder on a support surface, and a coupling part provided on a medial portion of the first holder body to support the tape roll; and a second holder body having a shape equal to the shape of the first holder body, wherein the coupling parts of the first holder and the second holder bodies are engaged with each other in a center hole of the tape roll and are coupled to each other.

Each of the coupling parts may have a coupling slot in a central portion thereof so that the first holder body and the second holder body are fastened to each other in such a way that the coupling slots of the first and second holder bodies engage with each other.

Furthermore, the width of the coupling slot of each of the coupling parts may be equal to the thickness of the tape holder.

Each of the coupling parts may have at least one locking stopper so that when the coupling slots of the coupling parts engage with each other, the locking stopper comes into close contact with an inner surface of the corresponding coupling slot.

Each of the first and second holder bodies may include a holder body surface and a holder flange provided around an entire edge of the holder body surface. The holder flange may have a constant thickness and height.

In the tape holder according to the present invention, when it is desired to replace a tape roll with another, the operation of separating coupling parts of the tape holder from each other and re-coupling them to each other can be easily conducted. Furthermore, the tape holder has a lighter structure and a stand shape so that its transport and storage are easy.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
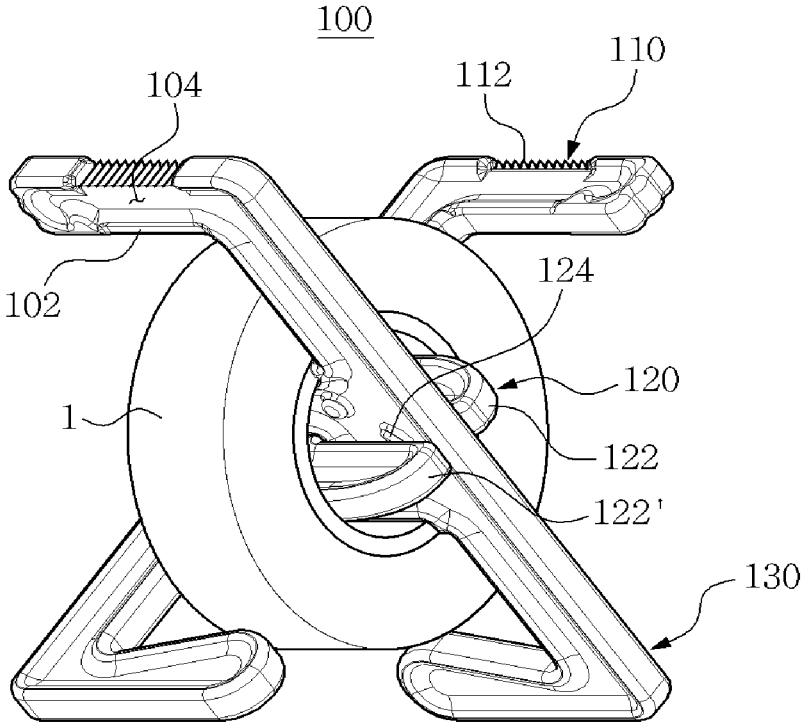
FIG. 1 is a perspective view of a tape holder, according to an embodiment of the present invention.

The terms and words used in the specification and claims must not be limited to typical or dictionary meanings, but must be regarded as concepts selected by the inventor as concepts which best illustrate the present invention, and must be interpreted as having meanings and concepts adapted to the scope and spirit of the present invention to aid in understanding the technology of the present invention.

Therefore, the construction of the embodiment illustrated in the specification and the drawings must be regarded as only one illustrative example, and these are not intended to limit the present invention. Furthermore, it must be understood that various modifications, additions and substitutions are possible at the point of time of application of the present invention.

Hereinafter, a preferred embodiment of the present invention will be described in detail with reference to the attached drawings.

In the following description, a tape holder 100 will be illustrated as including a pair of holder bodies, that is, a first holder body 100' and a second holder body 100" which have the same shape and construction, and the same reference numerals are used to designate the same portions between the first and second holder bodies 100' and 100".

Figure 2:
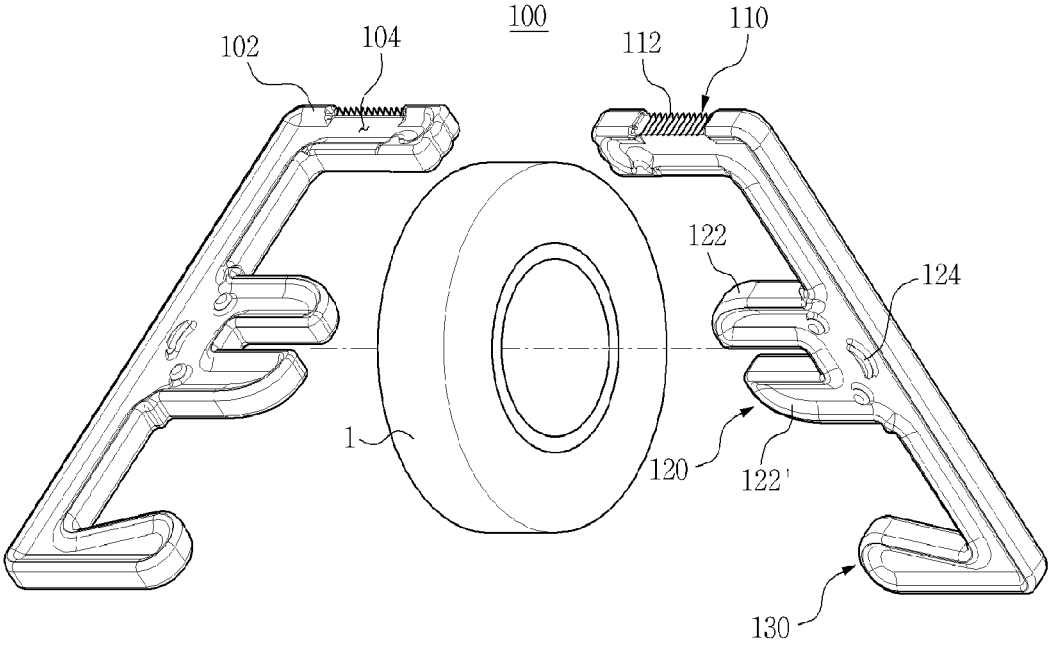
FIG. 2 is an exploded perspective view of the tape holder according to the embodiment of the present invention.

FIG. 1 is a perspective view of the tape holder 100, according to the embodiment of the present invention. FIG. 2 is an exploded perspective view of the tape holder 100.

As shown in FIG. 1, the tape holder 100 according to the present invention includes the first holder body 100' and the second holder body 100". The first holder body 100' has an overall 'E' shape and includes a cutting part 110 which is formed on a first end thereof and on which a cutter 112 is formed to cut tape 1, a support part 130 which is formed in a second end thereof and is placed on a support surface, and a coupling part 120 which is formed on a medial portion thereof to support the roll-shaped tape 1 (or tape roll 1). The second holder body 100" has the same structure as that of the first holder body 100'. The coupling part 120 of the first holder body 100' and the coupling part 120 of the second holder body 100" are inserted into a center hole of the tape roll 1 and engage with each other.

As shown in FIG. 2, the first and second holder bodies 100' and 100" which are inserted into the center hole of the tape roll 1 and coupled to each other intersect at the right angle.

Figure 3:
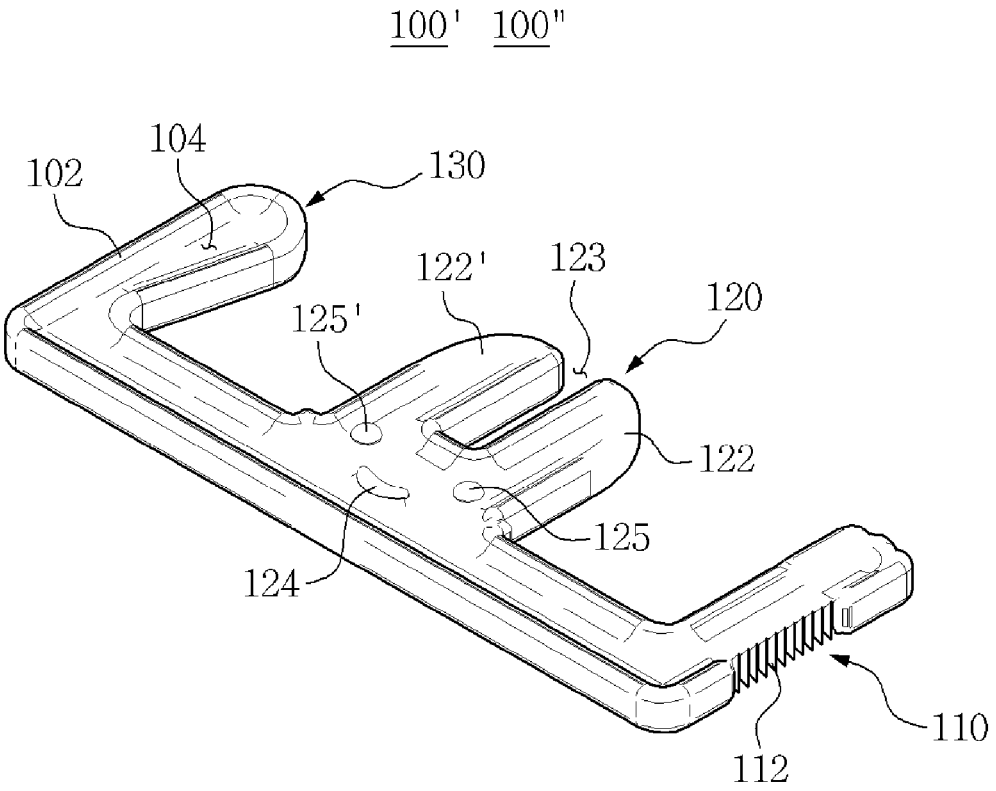
FIG. 3 is a perspective view illustrating one of a pair of holder bodies constituting the holder according to the embodiment of the present invention.

FIG. 3 is a perspective view illustrating one of the two holder bodies 100' and 100" constituting the holder 100.

The construction of each of the first and second holder bodies 100' and 100" will be explained in detail with reference to FIG. 3. The overall shape of each holder body 100', 100" refers to a face, arms and legs.

The coupling part 120 includes protrusions 125 and 125' which correspond to the eyes of the face, a locking stopper 124 which corresponds to the mouth, and horns 122 and 122' which define a coupling slot 123 and correspond to the head. The cutting part 110 is configured such that the cutter 112 is formed in a portion corresponding to the arm and the end of the cutting part 110 has a hand shape. The shape of the support part 130 is that of a foot of the leg. As such, the overall shape of each holder body 100', 100" is in consideration with design factors.

As such, because the first holder body 100' and the second holder body 100" are manufactured in the same shape and coupled to each other to form the tape holder 100, the production of products can be facilitated.

Figure 4:
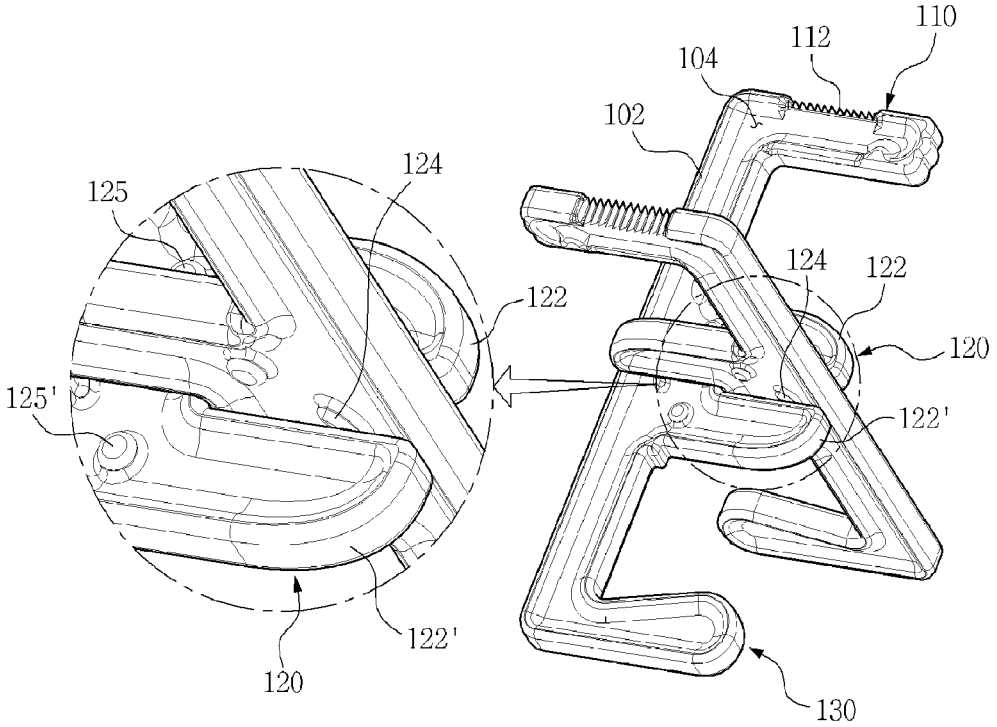
FIG. 4 shows an enlargement of a coupling part of the holder according to the embodiment of the present invention.

FIG. 4 shows an enlargement of the coupling part of the holder according to the embodiment of the present invention.

In each of the first and second holder bodies 100' and 100", a holder flange 102 which has a constant thickness and height is provided around an entire edge of a holder body surface 104. The height of the holder flange 102 is the same as that of the locking stopper 124. The thickness of the tape holder 100 is the same as the width of the coupling slot 123.

Due to the above-mentioned structure, when the first holder body 100' and the second holder body 100" which have the same thickness as the width of the coupling slot 123 formed in the coupling part 120 are coupled to each other at the right angle, they can be automatically fastened to each other by friction.

In addition, friction does not occur on the holder body surface 104 other than on the holder flange 102 and the locking stopper 124. Therefore, the coupling and separation of the first and second holder bodies 100' and 100" can be smoothly conducted.

Figure 5:
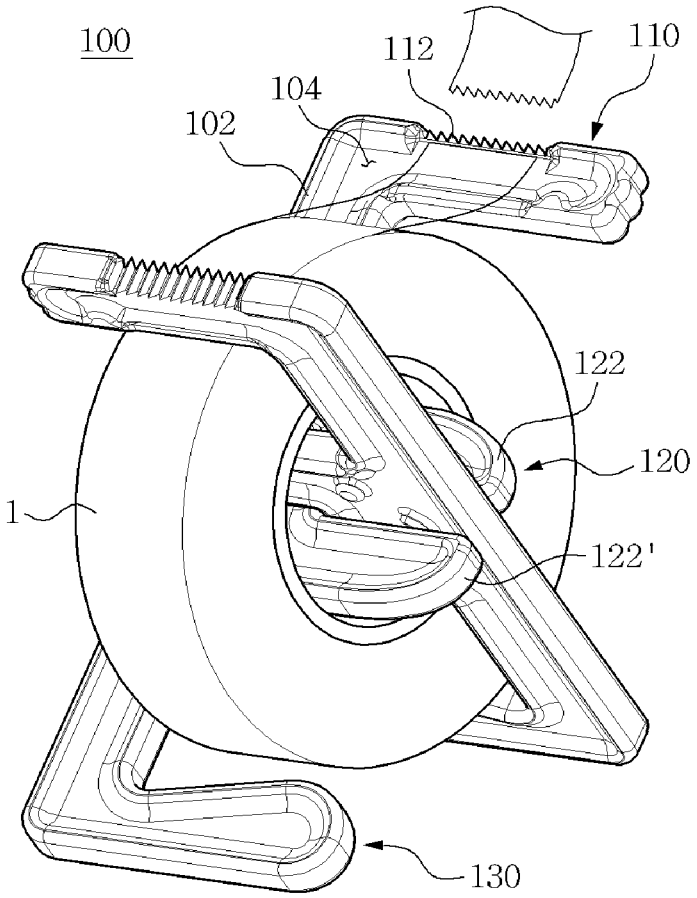
FIG. 5 is a view illustrating use of the holder according to the embodiment of the present invention.

FIG. 5 is a view illustrating use of the tape holder 100 according to the embodiment of the present invention.

As shown in FIG. 5, because the cutters 112 formed in the cutting parts 110 are disposed at both sides, the operation of cutting tape of the tape roll 1 can be carried out regardless of the orientation of the tape roll 1 installed in the tape holder 100.

Although it is not shown in the drawings, the cutter 112 is preferably also formed in each support part 130 as well as in each cutting part 110. In this case, regardless of the orientation in which the tape holder 100 is placed on the support surface, the operation of cutting the tape from the tape roll 1 can be conducted.

As stated above, the coupling parts 120 of the first and second holder bodies 100' and 100" which have the same shape are inserted into the center hole of the tape roll 1 and coupled to each other. Here, the holder flange 102 and the locking stopper 124 have the same thickness as that of the width of the coupling slot. Thereby, the first and second holder bodies 100' and 100" can be smoothly coupled to each other or separated from each other. Further, the manufacture of the product can be facilitated, and the production cost can be reduced.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A tape holder for supporting a tape roll and cutting tape from the tape roll, comprising:

a first holder body having an overall 'E' shape and including: a cutting part provided on a first end of the first holder body, with a cutter formed in the cutting part to cut the tape; a support part provided on a second end of the first holder body to support the tape holder on a support surface; and a coupling part provided on a medial portion of the first holder body to support the tape roll; and a second holder body having a shape equal to the shape of the first holder body, wherein the coupling parts of the first holder and the second holder bodies are engaged with each other in a center hole of the tape roll and are coupled to each other.

2. The tape holder as set forth in claim 1, wherein each of the coupling parts has a coupling slot in a central portion thereof so that the first holder body and the second holder body are fastened to each other in such a way that the coupling slots of the first and second holder bodies engage with each other.

3. The tape holder as set forth in claim 2, wherein a width of the coupling slot of each of the coupling parts is equal to a thickness of each of said holder bodies.

4. The tape holder as set forth in claim 2, wherein each of the coupling parts has at least one locking stopper so that when the coupling slots of the coupling parts engage with each other, the locking stopper comes into close contact with an inner surface of the corresponding coupling slot.

5. The tape holder as set forth in claim 1, wherein each of the first and second holder bodies comprises a holder body surface and a holder flange provided around an entire edge of the holder body surface, the holder flange having a constant thickness and height.

* * * * *